United States Patent [19]

Hickey

[11] Patent Number: 4,961,717

[45] Date of Patent: Oct. 9, 1990

[54] TOY CONTAINING DENTAL CLEANING APPARATUS

[76] Inventor: Robert C. Hickey, 5701 Katydid La., Austin, Tex. 78744

[21] Appl. No.: 468,136

[22] Filed: Jan. 22, 1990

[51] Int. Cl.[5] ..... A63H 27/00; B65D 83/10; A46B 17/00

[52] U.S. Cl. ..... 446/76; 132/308; 206/457; 206/15.2; 206/362.2

[58] Field of Search ..... 446/76, 71, 73, 74, 446/77; 132/308–311; 206/457, 15.2, 362.2, 229

[56] References Cited

U.S. PATENT DOCUMENTS

| | | | |
|---|---|---|---|
| 1,400,954 | 12/1921 | Holloway et al. | 132/311 X |
| 2,630,912 | 3/1953 | Warner et al. | 206/15.2 |
| 3,105,612 | 10/1963 | Krasnoff et al. | 446/74 X |
| 3,354,576 | 11/1967 | Gralnick | 446/76 |

*Primary Examiner*—Mickey Yu
*Attorney, Agent, or Firm*—Robert W. Jenny

[57] ABSTRACT

The apparatus is a scale model of the U.S. Space Shuttle complete with external fuel tank and booster rockets. The fuel tank/booster rockets assembly is separable from/attachable to the space shuttle. The space shuttle houses a toothbrush attached to the inside of the nose cone and the fuel tank encloses a supply of dentifrice. In use, the nose cone and toothbrush assembly is removed from the space shuttle body, dentifrice is applied from the fuel tank and the brush is used either with the nose cone as a grip or with the nose cone inserted inverted in the body so that the body serves as the grip. The nose cone of the fuel tank is hinged to open for installation and dispensing of the dentrifice which is in a capsule. The dentifrice is delivered from an aperature in the back end of the fuel tank.

2 Claims, 2 Drawing Sheets

FIG. 4
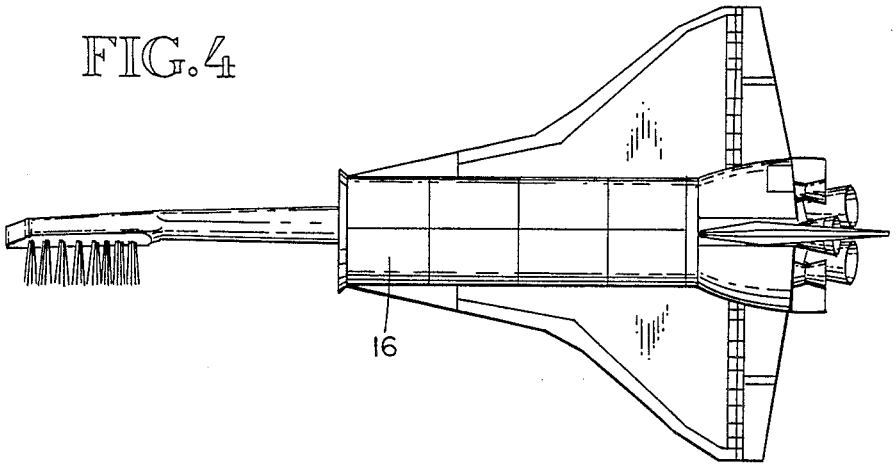
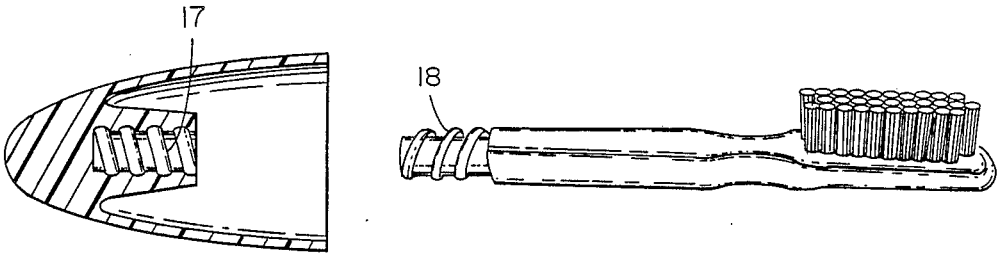
FIG. 5
FIG. 6
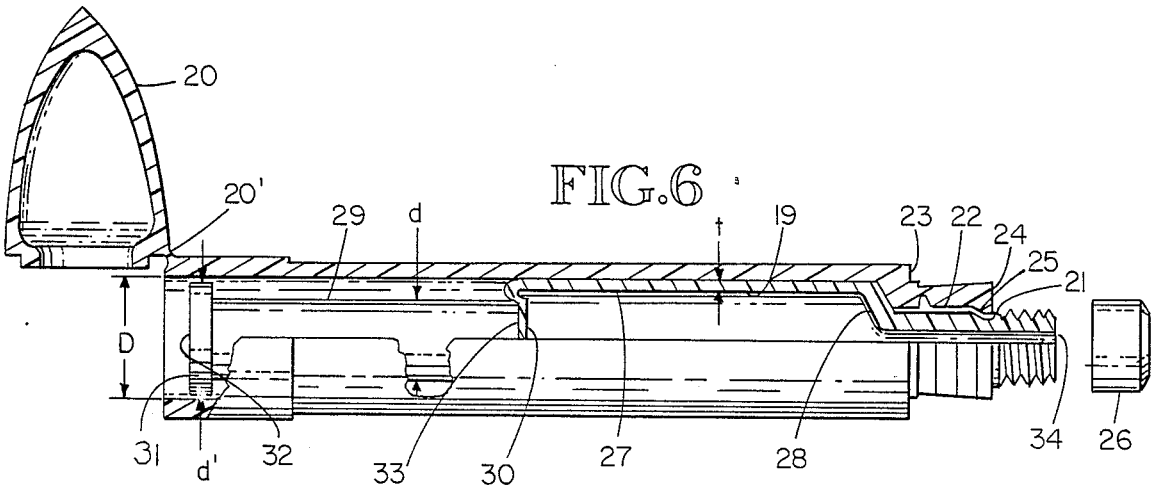

TOY CONTAINING DENTAL CLEANING APPARATUS

BACKGROUND OF THE INVENTION

1. Field

The subject invention is in the field of toys which incorporate useful apparatus, in particular toys incorporating apparatus for cleaning teeth. Accordingly it is also in the field of devices and apparatus for holding or containing dental cleaning items and the dentifrice used with such items.

2. Prior Art

The patents listed below constitute the prior art in these fields known to the applicant.

| United States Design Patents | | Utility Patents |
|---|---|---|
| 237,659 | 273,406 | 2,034,595 |
| 261,286 | 287,791 | 2,082,834 |
| 293,806 | | 2,576,550 |

The listed utility patents show containers for a toothbrush and the related dentifrice but none of the containers are toys. Two of the design patents show toys which incorporate but do not contain a toothbrush. Therefore the prime objective of the subject invention is to provide a toy which incorporates and conceals a toothbrush and a supply of dentifrice. A second objective is that the toothbrush be totally contained in the toy when not in use, making the container fully useful as a toy without chance for contamination of the toothbrush. A third objective is that the apparatus minimize the dexterity required in the use of the apparatus in terms of the manipulation of the toothbrush.

SUMMARY OF THE INVENTION

The invention is a model of the well-known United States Space Shuttle, including its external fuel tank and solid propellant booster rockets. The shuttle and fuel tank are hollow. The nose section of the shuttle is removable and a toothbrush is fastened into the nose section so that when the nose section is in place on the shuttle the toothbrush is housed in the body of the shuttle. To use the toothbrush the nose section with nose section attached is removed and the nose section serves as a grip for the toothbrush. Alternately, the nose section can be inserted into the body with the toothbrush exposed and in that case the body serves as the grip for the toothbrush.

The fuel tank/booster rocket portion is attachable to/detachable from the space shuttle. A supply of dentrifice is stored in the fuel tank. The nose section of the fuel tank is hinged to open and close and when open, provides access to the dentifrice. The fuel tank may serve as a storage place for a tube of dentifrice or may incorporate dispensing apparatus by which the dentrifice is delivered through an aperture at the back end of the tank. With the dispensing apparatus the dentifrice is packaged in packets which fit into the tank and are replaceable when emptied or to vary the type of dentifrice used.

The invention is described in more detail below with reference to the attached drawings.

BRIEF DESCRIPTION OF THE DRAWINGS

FIG. 4 illustrates the nose section inserted inverted into the body of the shuttle with the toothbrush exposed.

FIG. 5 illustrates the toothbrush detached from the nose section and the nose section sectioned to show the threads for attachment of the toothbrush.

FIG. 6 is a partially sectioned view taken at 6—6 in FIG. 2 of the fuel tank and booster rocket portion showing the dentifrice capsule in place in the fuel tank and the nose section of the fuel tank open to allow manipulation of the dentifrice supply apparatus to deliver dentifrice from an aperture at the end of the fuel tank.

DETAILED DESCRIPTION OF THE INVENTION

The invention is a scale model of the U.S. Space Shuttle, complete with external fuel tank and booster rockets. The shuttle and tank/booster assembly are separable/attachable. The shuttle is hollow and houses a toothbrush attached to the inside of the nose section of the shuttle. The fuel tank is hollow and serves to store and dispense dentifrice used with the toothbrush.

Figure 1:
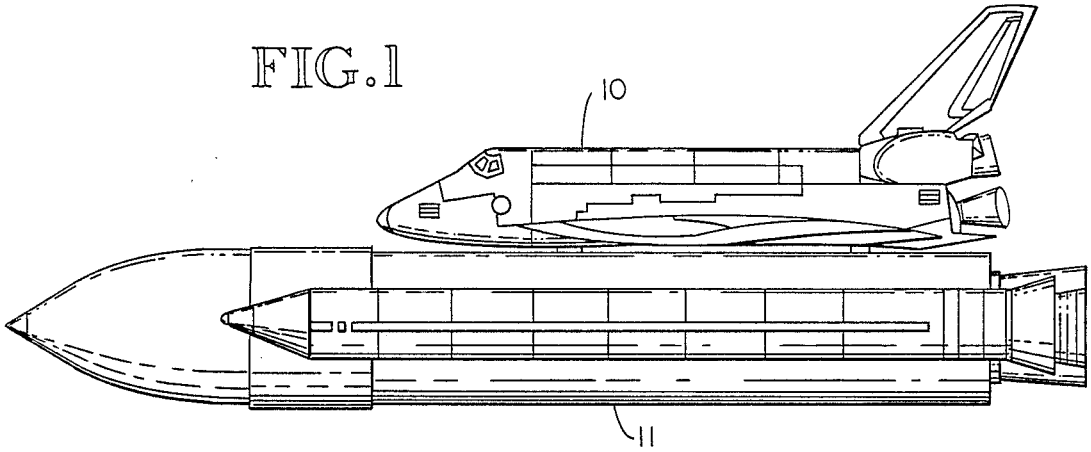
FIG. 1 is a side view of the completely assembled apparatus.
Figure 2:
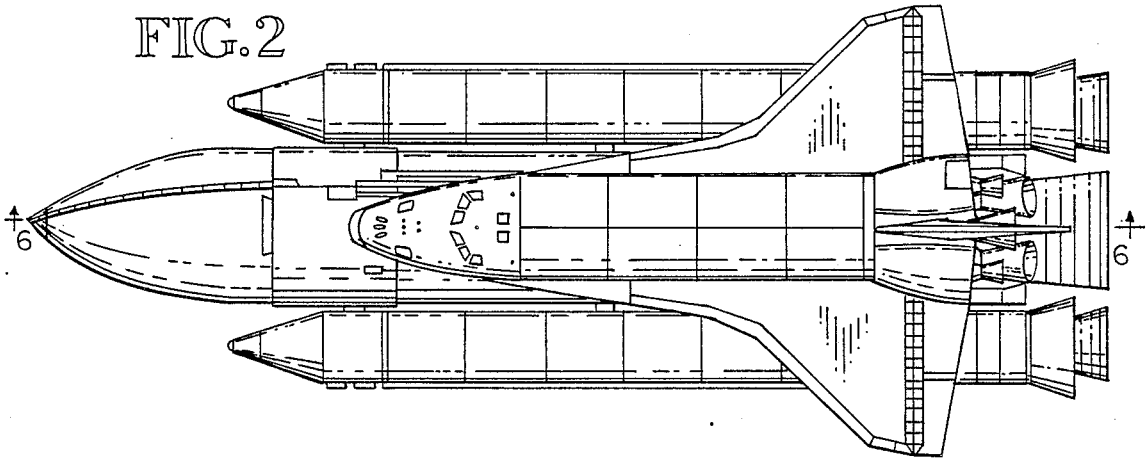
FIG. 2 is a top view of the completely assembled apparatus.
Figure 3:
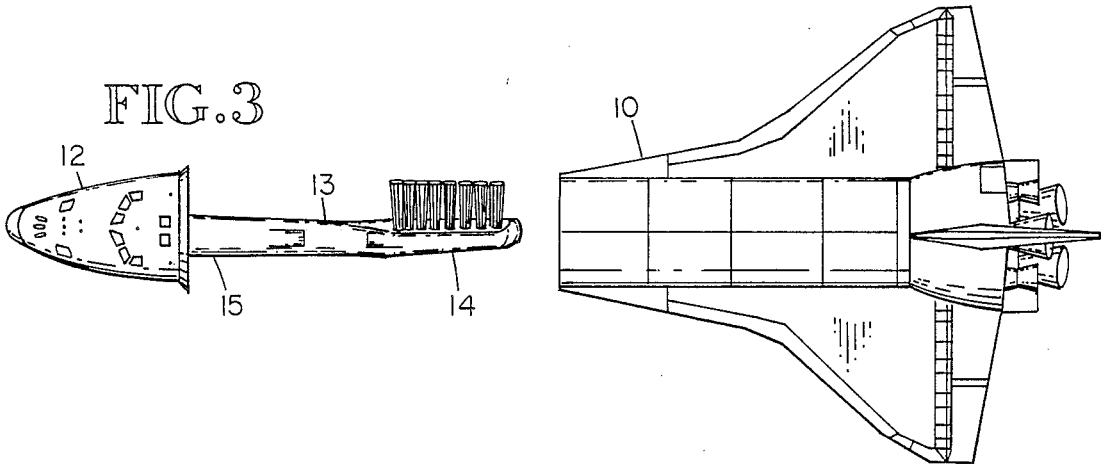
FIG. 3 is a top view of the shuttle with its nose section and the toothbrush attached to the nose section removed from the shuttle.

FIG. 1 is a side view of the completely assembled apparatus comprising a first hollow component, the shuttle 10, and the tank/ booster assembly 11. FIG. 2 is a top view of the completely assembled apparatus. FIG. 3 is a top view of the shuttle 10 with its nose section end 12 and toothbrush 13 detachably attached to the nose section removed from the shuttle. The toothbrush comprises a brush end 14 and a shaft end 15 and shaft end 15 is detachably attached to the inner side of end 12. The toothbrush may be used with the nose section providing a grip or, as shown in FIG. 4, the nose section can be inserted inverted into the body 16 of the shuttle with the toothbrush exposed so that the shuttle body provides the grip for the toothbrush. In this mode the nose section is held on the body by friction forces.

FIG. 5 illustrates the toothbrush detached from the nose section and the nose section is shown in sectional view to illustrate the threaded socket 17 into which threads 18 on the toothbrush are fitted to detachably attach the toothbrush to the nose section.

FIG. 6 is a partially sectioned view taken at 6—6 in FIG. 2 and illustrates a dentifrice container in the form of capsule 19 in place in the second hollow component, the fuel tank, with nose section end 20 of the fuel tank hinged at 20 and opened to allow insertion of the capsule into the tank. Neck 21 of the capsule fits through hole 22 in end 23 of the tank and is held in place by tab 24 engaging groove 25 in the neck. The capsule can be removed when empty or to change dentifrices by lifting the tab from the groove and using a pusher such as the end of a pencil to push the capsule out of the tank. Cap 26 may be provided with the capsule and snapped or threaded onto neck 21 to seal the capsule when no dentifrice is needed. When dentifrice is needed it can be forced through neck 21 by applying finger pressure to the capsule thru the opening provided by hinging open the nose section of the tank.

To describe the dentifrice capsule 19 in more detail, it comprises a thin walled plastic cylinder 27 and a conical end 28 from which neck 21 extends. The capsule further comprises cylindrical plug 29 positioned end-to-end with the capsule at end 30 of the thin walled plastic cylinder. Diameter d of the plug is slightly less than diameter D of the inside of the fuel tank minus 4 times the thickness t of the wall of cylinder 27. Diameter d' of flange 31 of the plug is slightly less than diameter D. To dispense dentifrice, pressure is applied to end 32 of the plug and end 33 moves into the plastic cylinder, turning the wall inside out as it moves. This action forces dentifrice from hole 34.

It is considered to be understandable from this description that the invention meets its objectives. It is clearly a toy which incorporates and conceals a toothbrush and a supply of dentifrice. The toothbrush and dentifrice are totally contained when not in use, with no chances for inadvertent contamination. The nose section or body attached to the toothbrush during use provide an ample grip on the toothbrush, minimizing dexterity needed for ample manipulation of the brush.

It is also considered to be clear from this disclosure that while one embodiment of the invention is described herein, other embodiments and modifications of the one described are possible within the scope of the invention which is limited only by the attached claims.

I claim:

1. A toy containing dental cleaning apparatus, said toy comprising:

a first hollow component having a removeable, replaceable end, a second hollow component having first and second ends, said first end being hinged on said component, said apparatus comprising:

a toothbrush having a brush end and a shaft end, said shaft end being detachably attached to said removable/replaceable end whereby when said removable/replaceable end is replaced said toothbrush is contained in said first hollow component and a container of dentifrice storable in said second hollow component.

2. The toy of claim 1 in which said second hollow component has a hole in said second end and said dentifrice container comprises means for dispensing dentifrice through said hole, whereby with said first end of said second hollow component hinged open and with pressure applied to said container, dentifrice is dispensed through said hole.

* * * * *